United States Patent [19]

DeSimone

[11] 4,053,438

[45] Oct. 11, 1977

[54] PROPENE TRIMER ALCOHOL PERFUME COMPOSITIONS

[75] Inventor: Robert S. DeSimone, Middletown, N.Y.

[73] Assignee: Polak's Frutal Works, Inc., Middletown, N.Y.

[21] Appl. No.: 711,341

[22] Filed: Aug. 4, 1976

[51] Int. Cl.[2] ..... C11B 9/00

[52] U.S. Cl. ..... 252/522; 260/632 R

[58] Field of Search ..... 252/522; 260/632 R

[56] References Cited

U.S. PATENT DOCUMENTS 3,959,396 5/1976 Ochsner et al. ..... 252/522

OTHER PUBLICATIONS

Arctauder, Perfume and Flavor Chemicals, published by author, Montclair, N. J., 1969, Monographs 2348, 2349, 2354, 2357, 2359, 2363, 2364, 3003, Chem. Ab. 81:118772d.

*Primary Examiner*—Veronica O'Keefe

*Attorney, Agent, or Firm*—William S. Alexander

[57] ABSTRACT

Perfume compositions are disclosed containing, as an odorant, propene trimer alcohols or esters of such alcohols with 1 to 4 carbon monocarboxylic acids.

4 Claims, No Drawings

PROPENE TRIMER ALCOHOL PERFUME COMPOSITIONS

This invention relates to novel olfactory oil compounds and to perfume compositions prepared therewith. Specifically, it relates to such compounds and compositions based on isononyl hydrocarbon backbones derived from propene trimers.

Over the past two decades a trend has been observable with the replacement of standard perfumery items traditionally isolated from natural oils and extracts with petrochemically derived synthetic equivalents. Thus, a large part of the linalool, citral, citronellal and beta-ionone presently consumed by the flavor and fragrance industry is synthesized from isoprene, isobutylene and acetylene (for example, see U.S. Pat. No. 3,688,255 assigned to Rhodia, Inc.; German Pat. No. 1,259,876 assigned to BASF; and U.S. Pat. No. 3,496,240 to Hoffman-LaRoche). These materials had in former years been isolated from boise de rose, lemongrass or citronella oils until increased labor costs or seasonal shortages forced prices beyond that of the synthetics, which have the advantages of relatively unlimited and steady supply, and a more uniform quality. Recent patents also teach that other natural extracts such as oakmoss and clove oil have synthetic counterparts such as the 3,5-dialkyl resorcylate esters (U.S. Pat. No. 3,634,491) and eugenol (U.S. Pat. No. 3,929,904), which will be available for use when economics make the natural products undesirable.

It is the object of this invention to provide a novel series of useful synthetic perfumery chemicals based on propene trimer alcohol and esters prepared therewith, and which exhibit a wide variety of fragrance notes. It is also an object of this invention to provide processes for preparing such perfumery chemicals. Yet another object is to provide perfume compositions containing, as essential ingredients thereof, the propene trimer alcohol and esters of this invention.

The use of certain aliphatic alcohols and esters based on nonyl hydrocarbons as perfumery additives is known. For example, 3,5,5-trimethylhexyl acetate is commercially available and finds some application in this area. Arctander (Perfume & Flavor Chemicals, published by author, Montclair, N.J., 1969) also notes 3-nonyl acetate, 2-nonyl acetate, and n-nonyl acetate as usable perfumery chemicals, although these do not appear to have found substantial commercial utility. Other esters of nine carbon alcohols have also been employed to some extent in the past.

The alcohol contemplated by this invention is prepared by hydration of commercially available propene trimer. The propene trimer starting material is a complex mixture of branched chain olefins containing principally isononenes having the structural formula:

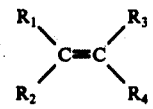

wherein $R_1$, $R_2$, $R_3$ and $R_4$ are hydrogen or aliphatic hydrocarbon radicals having 1 to 7 carbon atoms and the total of carbon atoms among $R_1$, $R_2$, $R_3$ and $R_4$ is 7. The structures for the nonenes contained in the trimer have been described as typically falling within the ranges shown in the following table:

Table 1

| Isomer Distribution of Commercial Propene Trimer | |
|---|---|
| Olefin Type | % Range |
| $RCH{=}CH_2$* | 1 to 4 |
| $RCH{=}CHR$* | 14 to 15 |
| $R_2C{=}CH_2$ | 8 to 11 |
| $R_2C{=}CHR$ | 35 to 37 |
| $R_2C{=}CR_2$ | 33 to 42 |

*At least one R has branched chain in these structures

A typical propene trimer has a refractive index ($N_D^{20}$) within the range from about 1.4230 to about 1.4280, a boiling range from about 135° to about 145° C. and a density within the range from about 0.7350 to about 0.7450. Using a 6 feet × ¼ inch stainless steel gas-liquid chromatography (GLC) column packed with Carbowax 20M on Chromasorb W, programmed from 75° to 160° at 4° C. per minute and 8-minute hold at 160° C., the GLC retention time is about 2.5 to 5.5 minutes, at about 60ml/minute helium flow.

GLC analysis of a commercial propene trimer distinguishes in excess of 90 isomers of the 9-carbon backbone with, very likely, many more unresolved. It is suprising to find that such a complex, synthetically derived raw material can be successfully and reproducibly employed to fashion perfumery chemicals having the natural odor effect observed with these materials.

The propene trimer alcohol is easily prepared by known methods, e.g., hydrohalogenation followed by heating in the presence of aqueous calcium hydroxide or by the sulfuric acid technique. Esterification of an acid with the propene trimer alcohol is likewise accomplished by known techniques.

The propene trimer alcohol and the esters prepared therewith are, like the propene trimer hydrocarbon starting material, complex mixtures of a large number of isomeric materials. However, GLC analysis of the alcohol as obtained by the hydration of propene trimer shows that none of the previously mentioned alcohols noted by Arctander (including 3,5,5-trimethyl hexanol, n-nonanol, 2-nonanol, and 3-nonanol) in found in the mixture making up the propene trimer alcohol. The reason for this is suspected to be the carbonium ion nature of the reactions used to form the propene trimer from propylene, the hydrochloric acid addition to the trimer to form nonene hydrochlorides and the solvolyis reaction of the hydrochloride with base. These chemical steps tend to favor both branching of the carbon backbone and formation of the most highly substituted tertiary alcohols. Thus, straight chain or primary alcohols would be expected to be absent from the mixture.

The desired mixture can be characterized by means of its refractive index, its density, its boiling points and boiling range, its gas/liquid chromatogram and by its odor to give a product for perfumery of reproducible and useful organoleptic quality. In particular, the alcohol mixture is distinguished by its GLC profile which has retention times distinctly different from any nonyl alcohol heretofore known as a perfumery additive when chromatographed on a six-foot by one-quarter inch stainless steel column packed with 20% Carbowax 20M on Chromasorb W operated at 75° to 160° C., programmed at 4° per minute with a helium flow of about 60 ml. per minute. More specifically, the alcohol and the useful fractions thereof can be characterized by

| | |
|---|---|
| Refractive Index ($N^{20}_D$) | 1.4308 to 1.4359 |
| Specific Gravity (Gross Alcohol) | 0.8305 at 25° C. |
| Boiling Range | 83° to 93° C. at 25 mm. Hg |
| GLC Retention Times (Conditions described above) | Between 12.4 and 16.4 minutes |

The alcohol can be used in perfumery after the fractionation normally used for such an aroma chemical as either a very wide blend incorporating all or most of the chemically produced alcohol isomers, or selected cuts can be used by themselves individually.

The esters herein described, being fashioned by esterification of the alcohol in known ways with 1 to 4 carbon straight chain monocarboxylic acids, their anhydrides or their chlorides, can be characterized by refractive index, density, boiling points, the gas/liquid chromatogram and the odor, to give a product of reproducible and useful organoleptic quality. More specifically, the acetate and useful fractions thereof can be characterized by

| | |
|---|---|
| Refractive Index ($N^{20}_D$) | 1.4232 to 1.4270 |
| Specific Gravity | 0.8685 to 0.8761 at 25° C. |
| Boiling Range | 108° C. at 45 mm. Hg to 97° C. at 20 mm. Hg |
| GLC Retention Times | R.F. between 16.3 and 18.3 minutes at 100–200° C., programmed at 2°/minute 6-foot by one-quarter inch stainless steel column packed with 20% Carbowax 20 on Chromasorb W, helium flow about 60 ml/minute |

The invention is illustrated by the following example.

EXAMPLE 1

A 12-liter, 3-necked flask equipped with a stirrer, a heating mantle and a condenser was charged with 3.1 kg. of commercial propene trimer ($N_D^{20}$ 1.4251, density 0.7375), 6.2 kg. of 30.2% hydrochloric acid and 31 ml. of a solution of 0.29 g. of hexadecyldimethyl ammonium chloride surfactant in one liter of 30.2% hydrochloric acid solution. The mixture was heated at 69°–θ° C. with agitation for 9.5 hours, at which time 60 more ml. of the surfactant was added. The mixture was heated at 70° C. for an additional 3 hours and 90 more ml. of the surfactant solution was added. After heating at 70° C. for yet an additional 5 hours, hydrogen chloride gas addition was begun and continued for an additional 13 hours. The organic phase was separated, yielding 3821 g. of a product containing 86.4% propene trimer chloride.

About 3800 g. of the propene trimer chloride was charged to a 22-liter flask equipped with a condenser, addition funnel and a static nitrogen head. Also charged to this flask were 3114 g. of calcium hydroxide (41% CaO), 8379 g. of water, 40 g. of Triton X 160, and 35.3 g. of powdered cuprous chloride. The mixture was heated to 77°–85° C. with stirring for 19 hours, at which point analysis showed the organic phase to contain 47% mixed isononyl alcohols. After addition of 100 g. of sodium hydroxide, the mixture was steam distilled, yielding 3096 g. of oil containing 42.6% alcohol. The crude propene trimer alcohol was charged into a 12-liter flask equipped with an addition funnel and a 3-ft. by 2-in. diameter Goodloe column and a reflux head. Residual propene trimer was distilled off at 27.5 mm. of mercury, head temperature 87°–106° C., and then at 17.5 mm. mercury, 93°–117° C. Acetic anhydride (1900 g.) was added and a mixture of acetic anhydride was distilled off at 300–325 mm. mercury, 90°–105° C. head temperature, while a comparable amount of acetic anhydride was added through the addition funnel to replace the distillate. Thereafter, 344 additional g. of acetic anhydride was distilled off and an additional 180 ml. was added to the pot. Remaining acetic anhydride was recovered at 190–240 mm. mercury at 97°–103° C. head temperature and the oil remaining in the flask was decanted from the sodium acetate and transferred with ether rinsing to a 3-liter flask containing one gram of Ionox 220, 50 g. of Primol 335, and 5 g. of sodium acetate. The flask was fitted with a 2-ft. 1-in. diameter Goodloe column and remaining acetic anhydride was distilled off. The remaining oil was distilled, and after separation of a portion containing 75–94% of isononyl acetates, separation of substantially pure acetates was begun. A total of 1363 g. of the acetate of propene trimer alcohol was recovered having characteristics listed in the following table:

Table 1

| Fraction | Boiling Point Temperature/ mm. Mercury | Purity g/c | Refractive Index $N^{20}_D$ | Density$^{25}$ |
|---|---|---|---|---|
| 1 | 108 – 45 mm. | ≧98% | 1.4232 | 0.8685 |
| 2 | 105 – 37 mm. | ≧98% | 1.4240 | 0.8702 |
| 3 | 100 – 32 mm. | " | 1.4240 | 0.8711 |
| 4 | 100 – 31 mm. | " | 1.4240 | 0.8712 |
| 5 | 100 – 31 mm. | " | 1.4240 | 0.8715 |
| 6 | 101 – 31 mm. | " | 1.4248 | 0.8732 |
| 7 | 92 – 21 mm. | " | 1.4250 | 0.8744 |
| 8 | 90.5 – 19 mm. | " | 1.4252 | 0.8750 |
| 9 | 75 – 7.5 mm. | " | 1.4260 | 0.8758 |

Olfactory properties of composite distilled fractions of the resulting acetates were evaluated as follows:

| | |
|---|---|
| Fractions 1 & 2: | Woody, tart with a rose butyrate and valerolactone background |
| Fractions 3, 4 & 5: | Smooth, woody, linalyl acetate character |
| Fractions 6, 7, 8 & 9: | Smooth, woody, dry |
| Composite 1 through 9: | Smooth, woody, fresh, clean ionone-type fragrance with a warm, dry background also having the fruitiness found in bergamot oil without its citrus topnote. |

EXAMPLE 2

Following substantially the same procedure as set forth in Example 1, the 630 g. of propene trimer which were recovered from the reaction in Example 1 (density: 0.7387, $N_D^{20}$: 1.4248) were converted to the alcohol and then to the acetate ester. The resulting acetate was distilled at about 81°–85° C. at 1.0–1.3 mm. of mercury. A total of 242 g. of the acetate was obtained. Fractions of 98.7% purity or better were combined to yield a product equivalent in odor characteristics to that obtained in Example 1, even though the mixture of isomeric nonenes in the starting trimer was different from that in Example 1. Physical characteristics of the resulting products are shown in the following tabulation:

Table 2

| Fraction | Boiling Point Temperature/ mm. Mercury | Purity g/c | Refractive Index $N^{20}_D$ | Density$^{25}$ |
|---|---|---|---|---|
| 1 | 82 – 1.0 mm. | 99.3 | 1.4256 | 0.8745 |
| 2 | 83 – 1.3 mm. | 98.9 | 1.4258 | 0.8743 |
| 3 | 84 – 1.3 mm. | 98.7 | 1.4259 | 0.8751 |
| 4 | 85 – 1.3 mm. | 99.3 | 1.4260 | 0.8755 |

These materials were of essentially the same odor type as those recovered in Example 1.

EXAMPLE 3

Into a one-liter flask, equipped with a sintered glass dispersion tube, stirrer and inlet and outlet gas bubblers, was charged 630 g. of propene trimer and 1 g. of $SnCl_4.5H_2O$. Gaseous hydrogen chloride was then added with cooling until the gas uptake became negligible. Time required was about 6 hours.

About 737 g. of the resulting mixed propene trimer chlorides, 2350 g. of water, 4.2 g. of cuprous chloride and 535 g. of sodium bicarbonate were charged into a 5-liter flask equipped with reflux condenser and mechanical agitator. The mixture was heated to 86° C. with stirring for about 51.5 hours. After cooling to room temperature, an oil phase was separated and washed four times with saturated sodium chloride brine and dried under anhydrous sodium sulfate. The oil was then charged into a 2-liter flask, one gram of sodium carbonate was added, and the mixture was distilled through a 2 ft. 1 in. Goodloe column. At about 107° pot temperature, 67.5 mm. of mercury, mixed nonyl alcohols of about 95% purity began to distill. Three such fractions were recovered having physical characteristics set forth in the following table:

Table 3

| Fraction | Boiling Point | Purity | $N^{20}_D$ | Density$^{25}$ |
|---|---|---|---|---|
| 1 | 107/67.5 mm. | 94.7 | 1.4330 | 0.8282 |
| 2 | 108/67.5 mm. | 99.5 | 1.4333 | 0.8310 |
| 3 | 119/67.5 mm. | 99.8 | 1.4332 | 0.8310 |

EXAMPLE 4

Crude propene trimer alcohol synthesized in a manner similar to Example 1 was distilled on a 36-plate column at 25 mm. mercury and 20:1 reflux ratio:

Table 4

| Fraction | Head Temperature (° C.) | Refractive Index $N^{20}_D$ | % Alcohol | Density$^{25}$ |
|---|---|---|---|---|
| 1 | 83 | 1.4308 | 99.0 | 0.8278 |
| 2 | 83 | 1.4312 | 99.8 | |
| 3 | 84 | 1.4322 | | |
| 4 | 84 | 1.4326 | | |
| 5 | 84 | 1.4328 | | 0.8286 |
| 6 | 84 | 1.4329 | | |
| 7 | 84 | 1.43329 | | |
| 8 | 85 | 1.4321 | | |
| 9 | 85 | 1.4332 | | 0.8304 |
| 10 | 85 | 1.4339 | | |
| 11 | 86 | 1.4331 | 99+ | 0.8317 |
| 12 | 86 | 1.4346 | | |
| 13 | 87 | 1.4348 | | |
| 14 | 87 | 1.4339 | | |
| 15 | 87 | 1.4355 | | |
| 16 | 88 | 1.4358 | | |
| 17 | 88 | 1.4345 | | |
| 18 | 89 | 1.4359 | | |
| 19 | 89 | 1.4340 | 99+ | 0.8343 |
| 20 | 89 | 1.4350 | | |
| 21 | 90 | 1.4345 | | |
| 22 | 90 | 1.4322 | | |
| 23 | 91 | 1.4331 | | |
| 24 | 92 | 1.4309 | | |
| 25 | 92 | 1.4309 | 99+ | |
| 26 | 93 | 1.4311 | | 0.8261 |

Olfactory properties of composite distilled fractions of the propene trimer alcohol were evaluated as follows:

| Fractions | Odor Description |
|---|---|
| 1–3 | green, minty |
| 4–6 | mild green, woody, linalool-like |

-continued

| Fractions | Odor Description |
|---|---|
| 7–10 | fresh green, very woody |
| 11–14 | mild, fruity green; linalool oxide notes |
| 15–20 | fruity, apple, fresh linalyl acetate note |
| 21–25 | linalyl butyrate; apple; mild, woody, green |
| 1–26 | clean, woody, green, leaf violet note with a linalool background. The bulk had a $N^{20}_D$ of 1.4347 and a specific gravity of 0.8305. |

EXAMPLE 5

A crude propene trimer alcohol (54.3% nonenes, 5% isononyl chlorides and 40.6% isononyl alcohols) and 1.4 g. of sodium hydroxide pellets was charged to a 250-ml. flask equipped with an addition funnel and fitted with a one-foot concentric tube column. After removal of the residual propene trimers, propionic anhydride (80 g.) was added. A mixture of the anhydride and propionic acid was continuously distilled off while additional make-up anhydride was added to replace it during a 7.5 hour period. A fraction was then distilled off at 50 mm. of mercury at 8°–110° C. head temperature, yielding 4.4 g. of mixed anhydride, chloride and water. Pure propionic acid ester of propene trimer alcohol was recovered at 30–33 mm. mercury at 100°–104° C. head temperature. Yield was 70%.

Fractions of the propionate were described as having a clean, fresh, woody, floral (muguet) character with some green freshness making the propionate applicable for use in herbal fragrances, citrus bouquets and floral muguets.

EXAMPLE 6

Into a 1000-ml. flask equipped with magnetic stirrer, cooling bath, additional funnel, thermometer and vented stopper was charged 284 g. of acetic anhydride and 130.6 g. of formic acid (90%) was added at 50° C. over a 3-minute period. A temperature of 50° C. was maintained for 15 minutes and the mixture then cooled to 27° C. prior to adding 24 g. of sodium acetate. Crude isononyl alcohol (54.3% nonene, 5% nonene hydrochloride and 40.6% propene trimer alcohol) was added at 20° to 15° C. in one portion and the mixture stirred at ambient temperature (~20° C.) for a total of 67 hours. The reaction mixture was combined with 500 ml. of water and 125 ml. of benzene. The organic phase was washed in succession with 50 ml. of 10% sodium hydroxide solution twice and 100 ml. of water twice. Each wash was in turn cross-extracted with the same 125 ml. portion of benzene.

The combined washed organic phases were then concentrated by distilling away pentene at 50 to 210 mm. mercury, 50° to 59° C. head temperature, and 55° to 81° C. pot temperature on a 50-plate glass micro concentric tube column. Formate admixed with varying amounts of alcohol was recovered at between 8 and 10 mm. mercury, 59° to 74° C. head temperature and 85°–93° C. pot temperature with pure formate being recovered at 8 mm. mercury, 74°–76° C. head temperature and 91°–150° C. pot temperature.

A composite of all the pure isononyl formate fractions had a minty, musty, dry, woody, tetrahydrolinalool note.

The propene trimer alcohols and their esters are used in any olfactorily effective amount, but usually in combination with other fragrance ingredients to form perfume compositions. In blends with such other ingredients they can constitute up to about 75%, preferably up to about 50%, and most preferably about 2 to 50% by weight of the total perfume composition. They can be used in any perfumery applications as, e.g., colognes, perfumes, and as detergent and cosmetic fragrances. The fresh, floral, woody note associated with these compounds makes them particularly useful in citrus-type colognes, woody muguets, fresh floral compositions and amber or animalic bases.

EXAMPLE 7

| Modern Lavender Perfume | Parts by Weight |
|---|---|
| Olibanum Resin, 50% in carbitol | 21 |
| Labdanum Resinoid | 6 |
| Cedarwood Oil | 15 |
| Lemon Oil, cold pressed | 30 |
| Lavendar Oil | 70 |
| Patchouli Oil (distilled) | 15 |
| Sandalwood Oil W. I. | 18 |
| Orange Oil | 20 |
| Ylang Ylang | 35 |
| Oakmoss | 9 |
| Aldehyde C-11, undecylenic | 1 |
| Aldehyde C-12, lauric | 4 |
| Anis Aldehyde | 20 |
| Hydroxy Citronellal | 120 |
| Methyl Ionone | 70 |
| Nopyl Acetate | 20 |
| Citronellol | 10 |
| Phenyl Ethyl Alcohol | 17 |
| Propene Trimer Acetate | 200 |

EXAMPLE 8

| Bergamot Type Perfume | Parts by Weight |
|---|---|
| Boise De Rose | 98 |
| Lemon Oil California, C.P. | 56 |
| Orange Terpenes | 200 |
| Diethyl Phthalate | 115 |
| Para-cymene | 8 |

-continued

| Bergamot Type Perfume | Parts by Weight |
|---|---|
| Caryophyllene | 4 |
| Verotyl | 1 |
| Benzyl Benzoate | 24 |
| Citral | 9 |
| Linalool | 139 |
| Propene Trimer Acetate | 406 |
| Terpinyl Acetate | 12 |
| Neryl Acetate | 10 |
| Dihydro Iso Jasmone | 5 |
| Rhodinol | 2 |

EXAMPLE 9

| Floral Perfume | Parts by Weight |
|---|---|
| Rhodinol Coeur | 135 |
| Propene Trimer Alcohol | 96 |
| Cinnamic Alcohol | 192 |
| Raldeine | 240 |
| Diethyl Phthalate | 87 |
| Geranium Bourbon | 29 |
| Jasmine Absolute | 29 |
| Linalool | 96 |

What I claim and desire to protect by Letters Patent is:

1. A perfume composition comprising an olfactory effective amount of propene trimer alcohol having a refractive index ($N_D^{20}$) of about 1.4308 to 1.4359 and density of about 0.8261 to 0.8317 and being essentially free of straight chain and primary alcohols or an ester of such a propene trimer alcohol with a carboxylic acid having 1 to 4 carbon atoms and at least one other olfactory ingredient.

2. A composition according to claim 1 wherein the olfactorily effective amount of the odorant is about 2 to 50%.

3. A composition according to claim 1 wherein the odorant is propene trimer alcohol.

4. A composition according to claim 1 wherein the odorant is the ester of propene trimer alcohol with acetic acid.

* * * * *